US005725683A

United States Patent [19]

Serafin et al.

[11] Patent Number: 5,725,683

[45] Date of Patent: Mar. 10, 1998

[54] MANUFACTURING CLEAR COATED ALUMINUM ALLOY LIGHTING SHEET

[75] Inventors: Daniel L. Serafin, Wexford; Paul B. Schultz, Murrysville; Albert L. Askin, Lower Burrell, all of Pa.; Paula Hinds, Lawrenceville, Ga.; David A. Linde, Bettendorf, Iowa; Robert E. Bombalski, New Kensington, Pa.

[73] Assignee: Aluminum Company of America, Pittsburgh, Pa.

[21] Appl. No.: 625,583

[22] Filed: Mar. 28, 1996

[51] Int. Cl.[6] ..... C22F 1/04; C23C 22/37

[52] U.S. Cl. ..... 148/265; 156/325; 148/549; 148/552; 148/691; 148/257

[58] Field of Search ..... 148/265, 275, 148/549, 552, 691, 415, 257

[56] References Cited

U.S. PATENT DOCUMENTS

| | | | |
|---|---|---|---|
| 3,945,899 | 3/1976 | Nikaido et al. . | |
| 4,400,487 | 8/1983 | Stoneberg et al. | 525/199 |
| 4,490,184 | 12/1984 | Forcht | 148/6.21 |
| 4,654,238 | 3/1987 | Yamazaki | 428/31 |
| 5,417,819 | 5/1995 | Askin et al. . | |
| 5,478,414 | 12/1995 | Mozelewski et al. . | |
| 5,480,498 | 1/1996 | Beaudoin et al. . | |

FOREIGN PATENT DOCUMENTS

| | | | |
|---|---|---|---|
| 740880 | 11/1955 | United Kingdom | 148/275 |

*Primary Examiner*—Sam Silverberg
*Attorney, Agent, or Firm*—Glenn E. Klepac

[57] ABSTRACT

A process for making an aluminum alloy lighting sheet product having a reflective surface protected by a UV-stable polymer coating. An aluminum alloy sheet is chemically brightened in an aqueous acidic solution, conversion coated, and then coated with a UV-stable polymer. Alternatively, an aluminum alloy sheet is chemically etched in an aqueous alkaline solution, conversion coated, and then coated with a UV-stable polymer. Preferably, the UV-stable polymer contains about 0.5–10 wt. % amorphous silica particles. In another embodiment, an aluminum alloy sheet surface is cleaned, chemically conversion coated and then coated with a coating composition containing a UV-stable polymer and 0.5–10 wt. % of about 0.5–5 microns.

18 Claims, No Drawings

MANUFACTURING CLEAR COATED ALUMINUM ALLOY LIGHTING SHEET

FIELD OF THE INVENTION

The present invention relates to methods and compositions for making aluminum alloy sheet products having a specular or diffuse appearance, being corrosion resistant and having a highly reflective surface, without anodizing the surface.

BACKGROUND OF THE INVENTION

Although aluminum is ordinarily considered a bright metal, the surface appearance is generally specified by the customer as either having a semi-specular (matte-like) finish or a specular finish. In lighting applications, it is especially desirable that the aluminum have a highly reflective surface, regardless of the specularity of the finish. As used herein, the term "total reflectance" refers to the amount of incident light striking a surface that is reflected in any direction, and the term "highly reflective" refers to a surface which reflects 80% or more. As used herein, the term "specular reflectance" refers to reflectance measured at an angle which is equal to the angle of incidence. The matte-like or semi-specular finish is defined as an appearance which has a specular reflectance of less than 40%, while the specular finish refers to the finish which has a specular reflectance of greater than 40%, both measured at 30 degrees off of normal incident light, per ASTM E-430.

Some known processes for polishing aluminum to produce a highly reflective surface include chemical polishing or electropolishing, both generally carried out in an acidic bath. After polishing, the surface must be treated again to render it resistant to corrosion. In the prior art, corrosion resistance has generally been imparted to aluminum alloy surfaces by anodizing and then coating with a polymer layer. Nikaido et al U.S. Pat. No. 3,945,899 is an example of one prior art reference disclosing anodization of an aluminum alloy surface followed by coating, preferably with an organic polymer such as an acrylic resin or acrylic modified polyester.

Anodizing processes have been practiced commercially on aluminum lighting sheet products for several years. Although anodized surfaces are chemically stable and resistant to corrosion, the processes are expensive. In addition, anodized aluminum alloy surfaces are often subject to some iridescence and to some oxide crazing during subsequent forming or exposure to elevated temperatures.

A principal objective of the present invention is to produce an aluminum sheet having a highly reflective and corrosion-resistant surface, in either a specular or semi-specular finish, without anodizing the surface. The term "corrosion resistant" refers to a product that does not delaminate, peel or significantly yellow or whiten when exposed to 1,000 hours of cycled condensing humidity and UV light, per ASTM G-53.

A related objective of the invention is to provide a process for making aluminum alloy sheet with improved characteristics, such as improved resistance to crazing and improved control of iridescence while maintaining acceptable levels of scratch and dust resistance, formability, appearance, optical performance and long term durability, compared with prior art processes relying upon anodizing.

Additional objectives and advantages of our invention will become apparent to persons skilled in the art from the following detailed description.

SUMMARY OF THE INVENTION

In accordance with the present invention, there is provided a process for making an aluminum alloy sheet product having a reflective surface protected by a conversion coating and a polymer coating.

Aluminum sheet material of the invention is preferably made from an aluminum alloy. As used herein, the term "aluminum alloy" refers to an alloy containing about 90% or more aluminum, and one or more alloying elements. When alloying is necessary for mechanical performance, the preferred alloying elements are magnesium, usually comprising about 0.5 to 10 wt. % of the alloy, and manganese, usually provided at about 0.15 to 2 wt. % of the total alloy. Various aluminum alloys in sheet form are suitable for the practice of the present invention, including the alloys of the 1000, 3000 and 5000 series (Aluminum Association designations). Appropriate tempers include H1x, H2x, H3x and O-tempers (Aluminum Association designations). Aluminum-magnesium alloys of the AA5000 series are preferred, especially the AA5000 series alloys containing about 1.5 wt. % or less magnesium.

A suitable aluminum alloy would be a bright-rolled alloy which has a surface roughness of 0 to 3 micro-inches, a preferred mill finish which has a surface roughness of 4 to 13 micro-inches and a mill finish with a surface roughness of 14 or greater micro-inches.

Some suitable compositions include the 1050, 1100, 1085, 3003, 3004, 3005, 5005, 5050, 5052, 5252 and 5657 aluminum alloys (Aluminum Association series).

A particularly preferred AA 5005 alloy contains about 0.5 –1.1 wt. % Mg, 0.07–0.30 wt. % Si, 0.10–0.7 wt. % Fe, 0.03–0.20 wt. % Cu, 0.20 wt. % max. Mn, 0.10 wt. % max. Cr, 0.25 wt. % max. Zn, 0.15 wt. % max. other alloying elements and impurities, and remainder Al. More preferably, the alloy contains about 0.65–0.80 wt. % Mg, 0.07–0.09 wt. % Si, 0.10 –0.17 wt. % Fe, 0.03 –0.06 wt. % Cu, 0.010 wt. % max. Mn, 0.05 wt. % max. Cr, 0.10 wt. % max. Zn, 0.10 wt. % max. other alloying elements and impurities, and remainder Al.

For the specular product, the bright-rolled sheet may be immersed in an acidic cleaning/brightening bath to remove the lubricant film and to further improve the surface quality. The cleaning/brightening bath is preferably an aqueous solution containing phosphoric acid, sulfuric acid, nitric acid, dissolved aluminum and a copper salt that is maintained at a temperature above 150° F. A preferred bath temperature is about 200° F. Likewise, a suitable aqueous solution is known to contain phosphoric acid, nitric acid, dissolved aluminum and a copper salt.

The cleaned and brightened sheet may be desmutted, preferably in an aqueous acidic solution containing nitric or sulfuric acid or a mixture of sulfuric acid and chromic acid. The nitric or sulfuric desmutting solutions are generally used at ambient temperature, and the sulfuric-chromic acid solution is preferably heated to about 160° to 180° F.

For the matte-like, semi-specular product, the bright-rolled, preferred mill finish or mill-finish sheet is etched in an alkaline bath. A preferred caustic etching solution contains 50 g/L sodium hydroxide and an organic wetting agent, maintained at a temperature of about 150° to 160° F. Commercially available alkaline etching solutions containing sodium hydroxide or potassium hydroxide or mixtures thereof are also suitable. After etching, the sheet may be desmutted, preferably in a 20 wt. % sulfuric acid solution.

For both the specular and semi-specular finishes, a conversion coating is next applied to the sheet in order to assure good adhesion of the polymer coating and improved corrosion resistance of the final product. Both chrome-containing and chrome-free conversion systems are suitable. The chrome conversion coating generally contains a chromate and a phosphate. Some known non-chromate conversion coatings are solutions containing zirconate, titanate, molybdate, tungstate, vanadate and silicate ions, generally in combination with hydrogen fluoride or other fluoride compounds.

The conversion coated sheet may be rinsed and then dried thoroughly before it is spray coated or roll coated with a solution of a curable polymer. Some suitable polymers include polyesters, such as polyethylene terephthalate (PET) and polybutylene terephthalate (PBT), polyurethanes, polyvinyl chloride, nylon, polyolefins and various acrylics which are stable upon long-term exposure to ultraviolet (UV) radiation. A UV-stable polyester is particularly preferred.

The polymer coating is preferably dissolved in organic solvents such as methyl isobutyl ketone (MIBK) or methyl ethyl ketone (MEK) or butyl cellosolve, for example, in a concentration of about 35 wt. %. The solution is preferably roll coated or sprayed onto the sheet to produce a coating thickness of about 0.1 to 2 mils, preferably about 0. 1 to 1 mil. A polymer coating thickness of about 0.2 to 0.3 mils is usually sufficient for most indoor applications.

The polymer coating may also contain about 0.5 to 10 wt. % of a particulate additive. Particles of silica having an average size of about 0.5 to 5 microns are preferred. One suitable form of amorphous silica particles is sold by Davison Chemical under the name "Syloid 222" silica.

An alternative suitable process for producing a semi-specular finish is to clean the aluminum bright-rolled, preferred mill finish or mill-finish sheet, with or without a chemical etch or a chemical brightening, apply the conversion coating, and then to apply a polymer coating which contains a silicate additive in proportions of about 0.5 to 10 wt. %.

The polymer-coated sheet is heated in an oven to cure the polymer. The sheet will reach a peak cure temperature of about 400° to 500° F.

A particularly preferred 5005 alloy sheet is prepared from an ingot that is cast and homogenized according to conventional practice. The ingot is cast, scalped and then homogenized at an elevated temperature, typically at about 800° to 1050° F. for 2 to 24 hours.

In conventional practice, the homogenized ingot is next hot rolled and cold rolled to a sheet of desired thickness which is then partially annealed and slit to a predetermined width. We have found that sheet having an improved surface appearance is obtained by hot rolling, annealing, and then cold rolling instead of such conventional practice. Optionally, the sheet may be partially annealed after it is cold rolled.

As used herein, the term "hot rolling" refers to rolling that takes place at a metal entry temperature of about 450° to 1000° F. (232° to 538° C.) for aluminum alloys. Hot rolling is typically used to reduce slabs of aluminum alloy material several inches thick into sheets having a thickness of about 0.10 inch to 0.25 inch and typically about 0.125 inch (0.32 cm). After hot rolling, the metal exit temperature is in the range of about 300° to 600° F., preferably about 300° to 400° F.

The term "cold rolling" refers to rolling in which metal entry temperature ranges from ambient temperature to about 150° F. (54° C.) for aluminum alloys. Cold rolling is typically used to reduce sheets of aluminum alloy material to sheets having the desired thickness and surface finish.

The term "annealing" refers to heating in an oven at temperatures of about 600° to 900° F. for about 1 to 24 hours. The annealing temperature is preferably greater than the metal temperature at exit from the hot rolling process, and more preferably in the range of about 600° to 700° F.

The term "partial annealing" refers to heating in an oven at a temperature of about 300° to 500° F. for about 1 to 24 hours. Partial annealing may be employed to provide desired mechanical properties and formability in the sheet product.

In a particularly preferred embodiment, a slab of 5005 alloy having a thickness of about 20 inches (50 cm) is hot rolled to a thickness of less than 0.30 inch, preferably about ⅛ inch (0.32 cm). The metal is then annealed at 600° to 650° F. for 2 hours. The sheet is then cold rolled. Upon completion of cold rolling, the sheet may be partially annealed at 300° to 500° F. for about 6 hours. A particularly preferred partial annealing temperature is about 400° F.

The metal thickness, after cold rolling, ranges from 0.010 to 0.072 inch and is preferably about 0.016 to 0.025 inch.

The hot rolled sheet has a highly fragmented grain structure that ordinarily survives even after cold rolling. We have found that annealing the sheet after hot rolling and before cold rolling causes the grain structure to recrystallize into a shorter, less striated and more equiaxed grain structure. After the sheet is cold rolled to a lesser thickness, it remains free of the long grains responsible for streaky, directional appearance in the final polymer coated product. Appearance of the polymer-coated sheet is improved, both when the sheet is conversion coated and then polymer coated or when it is anodized.

DETAILED DESCRIPTION OF THE PREFERRED EMBODIMENTS

For the specular finish, the bright-rolled sheet may be immersed in an aqueous cleaning/brightening bath. One such bath may contain about 75 wt. % phosphoric acid, 15 wt. % sulfuric acid, 2 to 3 wt. % nitric acid and about 800–1000 ppm copper salts. The bath temperature is 200° F. One such other bath is an aqueous solution containing 80–85 vol.% phosphoric acid, 2 to 3 wt. % nitric acid, 10 to 40 ppm dissolved aluminum and 50 to 200 ppm copper salts. The cleaned and brightened sheet may then be desmutted in an aqueous solution containing about 50 wt. % nitric acid. Desmutting removes residual copper and oxides remaining on the sheet after cleaning and brightening.

For the semi-specular finish, a bright rolled, preferred mill finish or mill-finish sheet may be etched in an alkaline bath. The preferred caustic etching solution contains 50 g/L sodium hydroxide and an organic wetting agent, maintained at a temperature of about 150° to 160° F. After etching, the sheet may be desmutted, preferably in 20 wt. % sulfuric acid solution.

The desmutted sheet is conversion coated, preferably in a solution containing chromate and phosphate ions. A commercially available BETZ 1904 conversion coating solution is particularly suitable. A BETZ 1903 conversion coating solution that is chromate free also performs well. The BETZ 1904 and BETZ 1903 conversion coating solutions are available from Betz Laboratories, Inc. of Trevose, Pa. The conversion coating solution, when not a dried-in-place coating, is rinsed, preferably in deionized water, and then dried thoroughly before polymer coating.

A particularly preferred UV-stable polyester is roll coated on the sheet from a 35 wt. % solution containing MIBK or MEK. The preferred coating thickness is about 0.2 to 0.3 mil.

The semi-specular finish may also be obtained by etching the bright-rolled, preferred mill finish, or mill-finish sheet in an aqueous alkaline bath, and subsequently conversion coating, then coating the sheet with a polymer coating which contains silica particles. The preferred caustic etching solution contains 50 g/L sodium hydroxide and an organic wetting agent, maintained at a temperature of about 150° to 160° F. After etching, the sheet may be desmutted, preferably in 20 wt. % sulfuric acid solution. The final polymer coating contains silica particles in concentrations of about 0.5 to 10 wt. %, preferably about 2 wt. %. The silica particles are preferably amorphous silica having an average particle size of about 0.5 –5 microns.

The semi-specular finish may also be obtained by brightening the bright-rolled, preferred mill finish, or mill-finish sheet in an aqueous cleaning/brightening bath, and subsequently conversion coating, and then coating the sheet with polymer coating which contains silica particles. One such bath may contain about 75 wt. % phosphoric acid, 15 wt. % sulfuric acid, 2 to 3 wt. % nitric acid and about 800 to 1000 ppm copper salts. The bath temperature is 200° F. Another such bath is an aqueous solution containing 80 to 85 vol.% phosphoric acid, 2 to 3 wt. % nitric acid, 10 to 40 ppm dissolved aluminum, and 50 to 200 ppm copper salts. The cleaned and brightened sheet may then be desmutted in an aqueous solution containing about 50 wt. % nitric acid. Desmutting removes residual copper and oxides remaining on the sheet after cleaning and brightening. The final polymer coating contains silica particles in concentrations between 0.5 and 10 wt. %.

The semi-specular finish may also be obtained by conversion coating, and then coating the sheet with a polymer coating which contains silica particles. The final polymer coating contains silica particles in concentrations between 0.5 and 10 wt. %, preferably about 2 wt. % of Syloid 222 silica.

The polymer-coated sheet is heated in an oven to cure the polymer. A peak cure temperature of about 400° to 500° F. is used.

Persons skilled in the art will understand that numerous variations and changes can be made in the preferred embodiment of our invention described above without departing from the spirit and scope of the following claims.

What is claimed is:

1. A process for making an unanodized aluminum sheet product having a reflective surface protected by a polymer coating, comprising:

(a) hot rolling an ingot of the AA 1000, 3000 or 5000 series to a sheet having a thickness of less than about 0.30 inch, annealing the hot rolled sheet for about 1–224 hours at a temperature greater than its exit temperature after hot rolling and in the range of about 600°–700° F., and cold rolling the annealed sheet to a thickness of about 0.010 to 0.072 inch;

(b) chemically brightening a surface of an aluminum alloy sheet by immersing said surface in an aqueous acidic solution, achieving a total reflectance of greater than 89%;

(c) without anodizing said sheet, chemically conversion coating the brightened surface to generate an adherent film of a metal compound;

(d) coating the unanodized brightened surface with a polymer by contacting said surface with a solution comprising a UV-stable polymer dissolved in an organic solvent and then evaporating said solvent; and (e) curing the polymer-coated surface at an elevated temperature.

2. The process of claim 1 further comprising:

(e) rinsing the conversion-coated surface after step (b) and drying to leave a dry brightened surface.

3. The process of claim 1 wherein the aqueous acidic solution of step (a) contains phosphoric acid, nitric acid, sulfuric acid, aluminum and copper.

4. The process of claim 1 wherein the aqueous acidic solution of step (a) contains phosphoric acid, nitric acid, aluminum and copper.

5. The process of claim 1 wherein the UV-stable polymer coated onto said surface in step (d) is a polyester or acrylic.

6. The process of claim 1 wherein said polymer contains about 0.5–10 wt. % silica particles having an average size of about 0.5–5 microns.

7. The process of claim 1 wherein the UV-stable polymer coated onto said surface in step (d) is a polyester or acrylic containing about 0.5–10 wt. % silica particles.

8. The process of claim 1 wherein the polymer-coated surface of step (e) has a coating thickness of about 0.1–1 mil.

9. The process of claim 1 further comprising partially annealing the cold rolled sheet at a temperature of about 300° to 500° F. for about 1–24 hours.

10. The process of claim 1 wherein the aluminum alloy sheet contains about 0.5–1.1 wt. % Mg, 0.07–0.30 wt. % Si, 0.10–0.7 wt. % Fe, and 0.03–0.20 wt. % Cu.

11. The process of claim 1 wherein the aluminum alloy sheet contains about 0.65–0.80 wt. % Mg, 0.07–0.09 wt. % Si, 0.10–0.17 wt. % Fe and 0.03–0.06 wt. % Cu.

12. A process for making an unanodized aluminum alloy sheet product having a reflective surface protected by a polymer coating, comprising:

(a) hot rolling an ingot of the AA 1000, 3000 or 5000 series to a sheet having a thickness of less than about 0.30 inch, annealing the hot rolled sheet for about 1–24 hours at a temperature greater than its exit temperature after hot rolling and in the range of about 600°–700° F., and cold rolling the annealed sheet to a thickness of about 0.010 to 0.072 inch;

(b) etching a surface of an aluminum alloy sheet by immersing said surface in a caustic solution, said sheet having total reflectance greater than 89% after said etching;

(c) without anodizing said sheet, chemically conversion coating the etched surface to generate an adherent film of a metal compound;

(d) coating the unanodized and etched surface with a UV-stable polymer coating dissolved in an organic solvent; and (e) curing said UV-stable polymer.

13. The process of claim 12 wherein said coating contains about 0.5–10 wt. % silica particles having an average size of about 0.5–5 microns.

14. A process for making an unanodized aluminum sheet product having a reflective surface protected by a polymer coating, comprising:

(a) hot rolling an aluminum alloy ingot of the AA 1000, 3000 or 5000 series to a sheet having a thickness of less than about 0.30 inch, annealing the hot rolled sheet for about 1–24 hours at a temperature in the range of about 600°–700° F. after hot rolling, and cold rolling the annealed sheet to a thickness of about 0.010 to 0.072 inch;

(b) chemically brightening a surface of the sheet by immersing said surface in an aqueous acidic solution or chemically etching said surface in an aqueous caustic solution, thereby achieving a total reflectance of greater than 80%;

(c) without anodizing said sheet, chemically conversion coating the brightened surface to generate an adherent film of a chemical compound; and (d) coating the unanodized brightened surface with a polymer by contacting said surface with a solution comprising a UV-stable polymer dissolved in an organic solvent, evaporating said solvent and then curing said polymer at an elevated temperature.

15. The process of claim 14 further comprising partially annealing the cold rolled sheet at a temperature of about 300° to 500° F. for about 1–24 hours.

16. The process of claim 14 wherein the sheet contains about 0.5–1.1 wt. % Mg, 0.07–0.30 wt. % Si, 0.10–0.7 wt. % Fe and 0.03–0.20 wt. % Cu.

17. The process of claim 14 wherein said sheet contains about 0.65–0.80 wt. % Mg, 0.07∝0.09 wt. % Si, 0.10–0.17 wt. % Fe and 0.03–0.06 wt. % Cu.

18. The process of claim 14 wherein said sheet contains an AA 5005, 5050, 5052, 5252 or 5657 aluminum alloy.

* * * * *

UNITED STATES PATENT AND TRADEMARK OFFICE

CERTIFICATE OF CORRECTION

PATENT NO. : 5,725,683

DATED : March 10, 1998

INVENTOR(S) : Daniel L. Serafin et al

It is certified that error appears in the above-indentified patent and that said Letters Patent is hereby corrected as shown below:

| | |
|---|---|
| Col. 5, line 51<br>Claim 1 | Change "224" to --24--. |
| Col. 6, line 49<br>Claim 12 | After "polymer", insert "coating". |
| Col. 8, line 5<br>Claim 17 | After "0.07", delete "∝" and insert therefor -- - -- (hyphen). |

Signed and Sealed this

Twelfth Day of May, 1998

Bruce Lehman

*Attest:*

BRUCE LEHMAN

*Attesting Officer*

*Commissioner of Patents and Trademarks*